US005240131A

United States Patent [19]

Keller

[11] Patent Number: 5,240,131

[45] Date of Patent: Aug. 31, 1993

[54] TAMPER EVIDENT CONTAINER CLOSURE

[75] Inventor: Robert G. Keller, Mountainside, N.J.

[73] Assignee: CPC International Inc., Englewood Cliffs, N.J.

[21] Appl. No.: 985,248

[22] Filed: Dec. 2, 1992

Related U.S. Application Data

[63] Continuation of Ser. No. 812,737, Dec. 23, 1991.

[51] Int. Cl.[5] ..... B65D 51/14

[52] U.S. Cl. ..... 215/230; 215/232; 215/270; 215/271; 215/274; 215/276; 215/349

[58] Field of Search ..... 215/230, 232, 258, 270, 215/271, 274, 276, 341, 346, 349, 350

[56] References Cited

U.S. PATENT DOCUMENTS

| | | | |
|---|---|---|---|
| 2,040,798 | 5/1936 | Schoonmaker | 215/271 |
| 2,194,004 | 3/1940 | Bukolt | 215/271 |
| 2,449,014 | 9/1948 | Shaffer | 215/276 X |
| 2,582,489 | 1/1952 | Krueger | 215/270 X |
| 4,122,964 | 10/1978 | Morris | 215/260 |
| 4,446,979 | 5/1984 | Gach et al. | 215/203 |
| 4,489,841 | 12/1984 | Thompson | 215/203 |
| 4,553,678 | 11/1985 | Thorsbakken | 215/218 |
| 4,653,643 | 3/1987 | Black | 215/271 X |
| 4,674,642 | 6/1987 | Towns et al. | 215/230 |
| 4,721,219 | 1/1988 | Dullabaun et al. | 215/274 |
| 4,747,497 | 5/1988 | Holman | 215/230 |
| 4,765,498 | 8/1988 | Rafferty | 215/230 |
| 4,778,069 | 10/1988 | Keller | 215/232 |
| 4,830,251 | 5/1989 | Conrad | 215/271 X |
| 4,877,143 | 10/1989 | Travisano | 215/230 |

*Primary Examiner*—Allan N. Shoap
*Assistant Examiner*—Vanessa Caretto
*Attorney, Agent, or Firm*—Brooks Haidt Haffner & Delahunty

[57] ABSTRACT

A tamper evident closure for a container has a seal member which is in a concave or convex condition to show closure integrity. The seal is visible through an opening in the cover of the container. Filling the container under pressure which is higher or lower than atmospheric produces the distention or contraction of the seal member that evidences that no tampering or leakage has occurred.

16 Claims, 2 Drawing Sheets

TAMPER EVIDENT CONTAINER CLOSURE

This application is a continuation of application Ser. No. 07/812,737, filed Dec. 23, 1991.

BACKGROUND OF THE INVENTION

1. Field of the Invention

This invention relates to tamper evident containers, and more particularly to closures having visible seals which reveal whether tampering or leakage has occurred, without the necessity of removing the closure to inspect the seal.

2. Description of Related Art

Containers such as jars with screw-on caps have been provided with various means for indicating tampering.

For example, my prior U.S. Pat. No. 4,778,069 discloses and claims a container having a tab extending from an inner seal through a slot in the container cover. Damage to the tab is indicative of tampering.

Patent No. 4,553,678 has a film or foil seal which is visible through a transparent screw cap.

Relative movement between an outer container cap and an inner liner is shown by indicia on the liner which can be seen through a window provided in the cap of patent No. 4,446,979.

In the package of U.S. Pat. No. 4,489,841, a color change in the skirt of a cap indicates that the package has been opened.

Patent No. 4,674,642 relates to a closure for a container having contents under vacuum. An inner liner has a projection which extends through an aperture in the container cap when vacuum is lost. However, if the container contents were an oil-based product such as peanut butter or mayonnaise, vacuum would be re-established after opening and re-closing of the container because of reaction of the contents with air admitted by opening of the container.

SUMMARY OF THE INVENTION

The tamper evident container closure of the invention includes an inner seal which is held in a concave or convex condition by a difference between the ambient pressure and the pressure of gas within the container. The inner seal is visible through an opening in a top panel of the closure. When tampering has ocurred the curvature of the seal will be changed or eliminated, making it evident that the tampering has occurred. Leakage of the seal will produce an effect similar to that of tampering. This will alert a retailer or consumer that the product should not be sold or purchased.

Two embodiments of the closure of the invention are illustrated. Although it may be desirable in some cases to employ an underpressure in the container to contract the inner seal into a concave state in many cases it is desirable for the seal to be held in a convex state, by overpressure as shown in the drawings for purposes of comparison of the two embodiments.

A convex condition also provides a tactile indication of security. Pressing upon the seal with a finger offers assurance of pressure, indicating that the seal has not been broached.

The closure of the invention provides external evidence that a container, such as a jar or bottle with a screw-on cap, has been subjected to tampering or leakage without resorting to complex devices which are costly to manufacture and which are, in some cases, unreliable. There will be fewer false positive signals of tampering than will result from some of the prior art expedients, and fewer false negative signals than there would be with other prior art devices.

According to the invention, the condition of an inner seal reveals whether the container has been tampered with or otherwise opened. When the container has been opened, the seal configuration changes from a convex or concave condition which denotes container integrity, to another condition, signaling that the container has been opened.

The invention is discussed with reference to closure for a jar with a screw-on cover, but the invention is applicable to covers secured to containers by other means than mating screw threads, and to closures for other types of containers.

The inner seal, which can be sealingly secured either to a lip of the container or to a container cap or lid as well reveals whether the container has been opened. The term "opened", as used herein, refers to either complete or partial removal of or leakage past the inner seal, which could expose the container contents to unintentional contamination or tampering.

The inner seal is visible through an aperture in the container cover, such as a circular central hole in a flat top panel of the cover. Enough of the periphery of such an apertured panel is retained to provide pressure for sealing to the seal surface of the container.

For some products which are not consumed after the first opening but are used repeatedly it is desirable that the aperture not be open when the cover is replaced. While this may be accommodated by retucking the seal member, it may be more desirable for the seal member to be sealed to the cover as well as the container rim. The seal to the rim must be sufficiently strong to retain a hermetic seal but sufficiently weak to fail by shear when opening.

The need to close this aperture may also be acommodated by using a two element seal part of which seals to the cover and part to the container rim. The two parts may be temporarily bonded with wax which melts allowing separation at the time of sealing.

Brief Description of the Drawing

In the several figures of the drawing, like reference characters indicate like parts.

DESCRIPTION OF THE PREFERRED EMBODIMENTS

Figure 1:
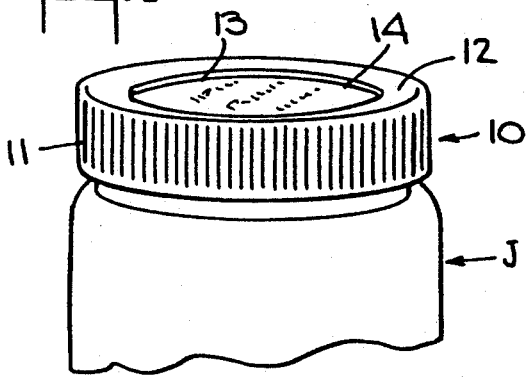
FIG. 1 shows a container provided with a tamper evident closure according to the invention.

The drawings show embodiments of the tamper evident container closure of the invention as applied to a screw-on cap of a wide mouth jar, although the invention can be employed in other types of closures, such as caps for bottles, etc.

The jar, generally designated by the reference character J in the several drawing figures, is hatched to indicate plastic material, but it could be a glass, ceramic or metal container.

Figure 2:
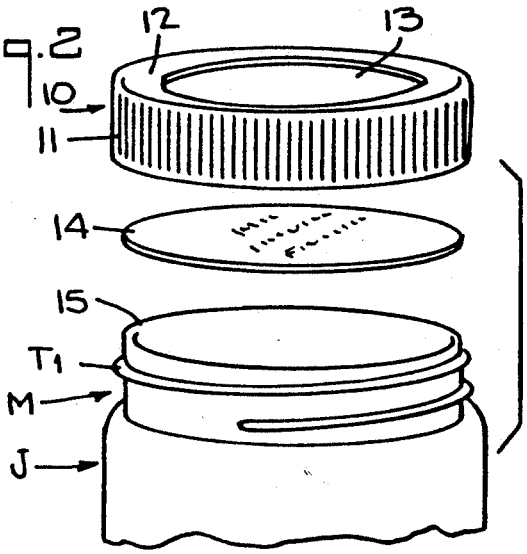
FIG. 2 is an exploded view of the container closure of FIG. 1 with a single element seal.
Figure 3:
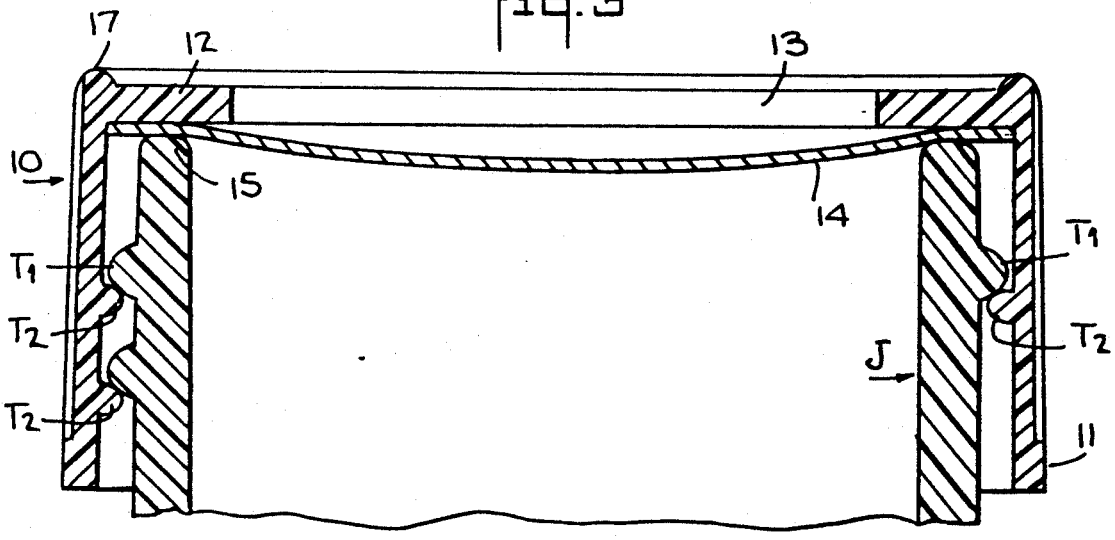
FIG. 3 shows the closure of FIGS. 1 and 2 in its sealed condition.
Figure 4:
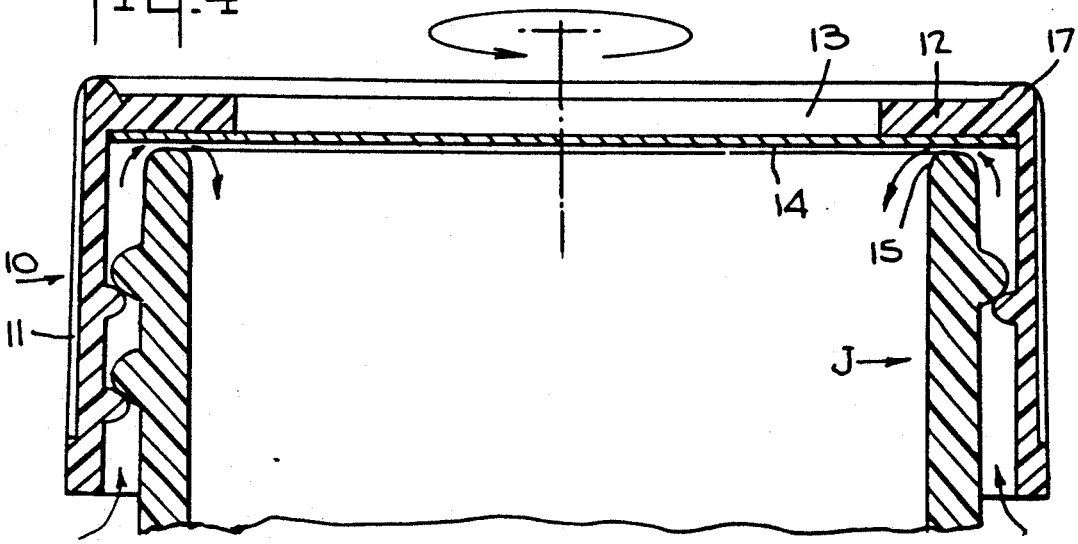
FIG. 4 shows the effect of opening the container of FIGS. 1–3 in the embodiment in which the seal remains affixed to the closure, but fails at the container interface by shearing.

As shown in FIG. 2, the jar J has an open mouth portion M provided with an integral outwardly projecting helical thread T1 for engagement with an inwardly projecting helical thread T2 of a cover 10 for the jar J as seen in FIGS. 3 and 4 when the cover 10 is screwed on to close the mouth of the jar J. The cover or cap 10, which may be of plastic material, has the usual annular lip 11 which carries the thread T2, which lip can have multiplicity of external vertical extending grooves to allow manual gripping without slipping of the hand when opening or closing the container.

The cover 10, instead of the conventional continous disc-shaped top panel, has only an annular peripheral portion 12, surrounding an opening 13 which occupies most of what would usually be the central area of a top panel of a cover. The annular peripheral portion 12 of the cover is sufficiently wide to provide pressure for sealing a seal member 14 to the rim 15 of the jar mouth M.

The seal member 14, which is preferably a die cut disc of flexible foil laminated plastic material and/or coated paper, is fitted in place within the cover 10 and applied to the container by use of radio frequency induction heating or some other conventional technique. The seal is secured to the rim 15 of the container. The contents of the jar J can be filled by a conventional process such as hot filling, nitrogen injection, under- or over-saturation with soluble gas, flushing of a head space above the contents with a soluble gas, or by any other known technique which will result in a head space pressure beneath the seal 14 that differs from atmospheric pressure.

In the embodiment illustrated in FIG. 3, the pressure in the head space within the jar J is lower than atmospheric, and the seal member 14 is accordingly deformed into the concave conformation illustrated. This contraction of the seal member 14 is readily apparent to one inspecting the seal through the opening 13 of the cover 10.

The cover 10 may also have a peripheral flange 17 for vertical stacking of containers.

FIG. 3 shows the jar J with its sealing member 14 in a concave disposition, indicating that no tampering or leakage has allowed outside air to enter the jar J. Alternatively, an outwardly distended, convex seal 24 and could indicate an overpressure in the jar J to signal that no leakage or tampering has taken place as in FIG. 6.

When the cover is rotatably displaced as shown in FIG. 4, the seal 14 moves away from the rim 15 of the jar J, allowing the internal and external pressures to equalize. FIG. 4 shows ambient air entering as illustrated by the direction of the arrows. If the contents were filled under an over-pressure, the pressurized gas would escape to the outside. In either case, the seal 14 will respond by taking on the unstressed flat conformation shown in FIG. 4. The flat surface of the seal 14 as shown in FIG. 4, visible through the central opening 13, signals that there has been tampering or leakage. The retailer will not sell, and the potential customer will not purchase, a product whose seal 14 is flat and thus warns of tampering or leakage.

Figure 5:
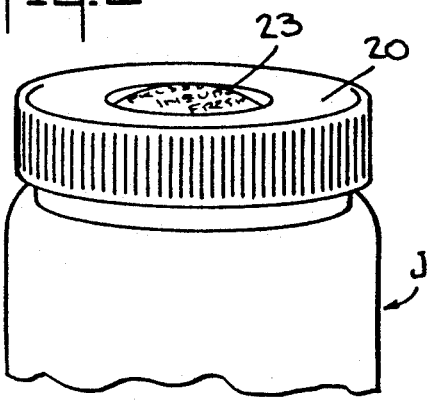
FIG. 5 shows another embodiment of the tamper evident closure of the invention wherein the seal is distended by internal pressure.
Figure 6:
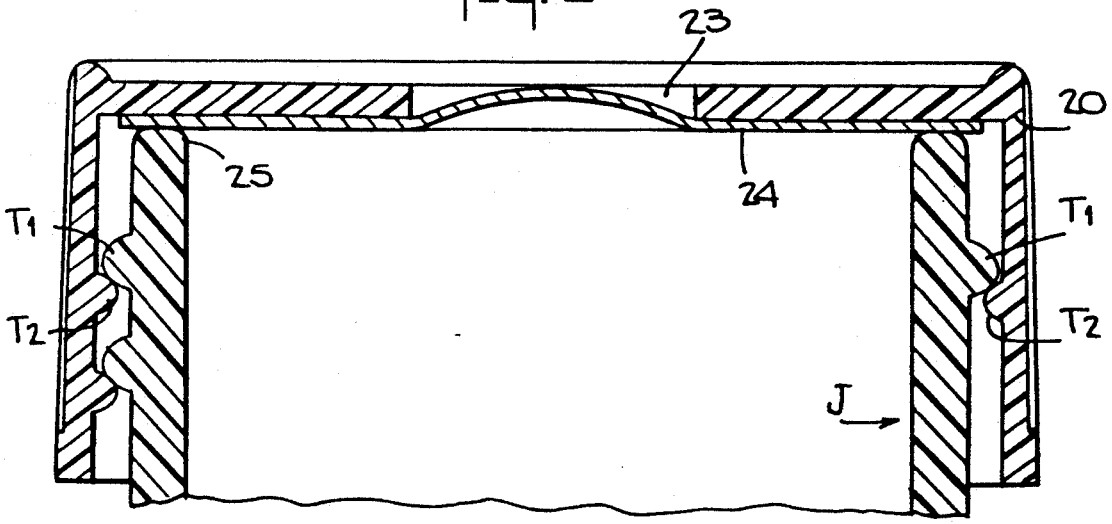
FIG. 6 illustrates the closure of FIG. 5 in sealed condition.
Figure 7:
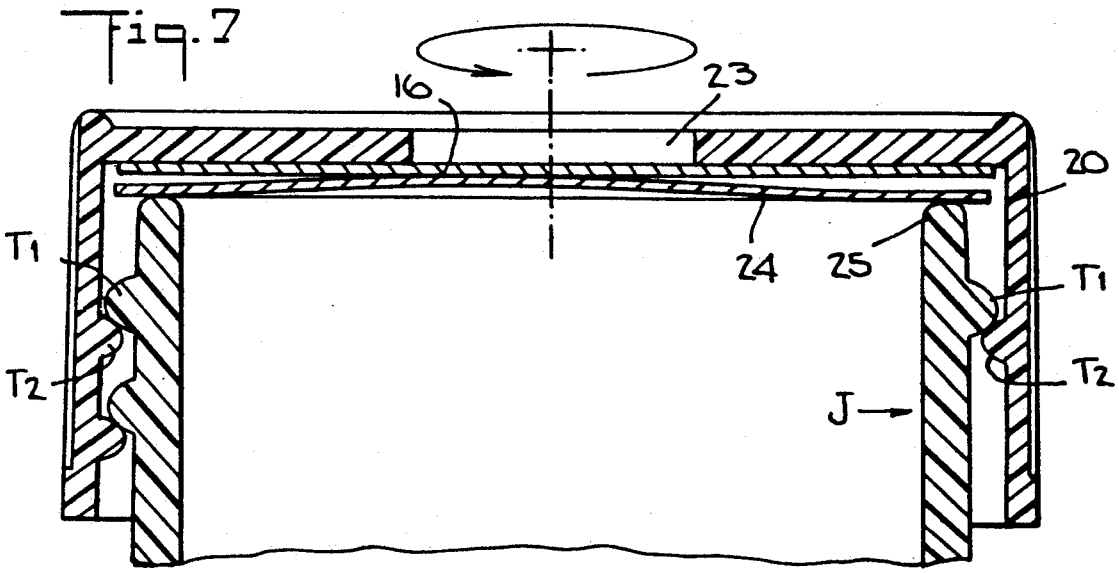
FIG. 7 shows the effect of unscrewing the cover of the container closure of FIG. 5 when the seal consists of two elements.

Modified versions of the closure according to the invention are shown in FIGS. 5-8. In the embodiment of FIGS. 5-6 the seam member 24 is sealingly secured, to the rim 25 of the jar J. The seal 24 is shown as having a convex curvature in its undisturbed state. FIG. 6 shows the jar J as it would be received after filling. FIG. 7 shows the removal of the cover 20 if the seal consists of two elements.

Figure 8:
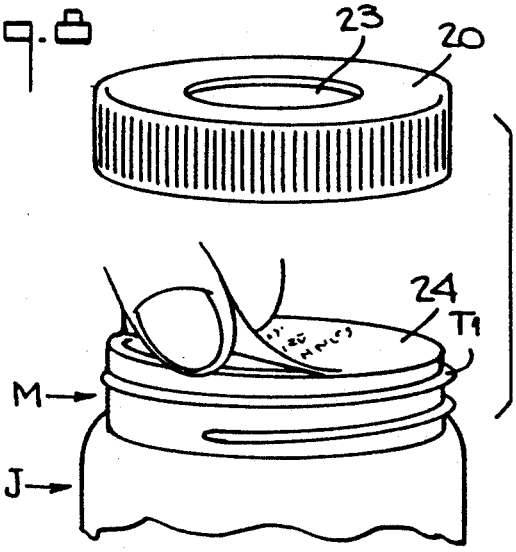
FIG. 8 shows breakage of the seal of the container closure of FIGS. 5 - 6 wherein the seal element is affixed solely to the container rim and is removed by peeling.

It is only when the seal member 24 is detached from the rim 25 of the jar J that the pressure difference between the interior space of the jar and the ambient is equalized. This is illustrated in FIG. 8. As shown in the drawings, the closure of FIG. 5-8 has a central opening 23 like the opening 13 of the embodiment of FIGS. 1-4, but the opening 23 can be smaller in diameter than the opening 13. The opening 23 permits inspection of the condition of the seal 24 or the combination of seal members 16 and 24 without removal of the cover 20.

Some oil based products such as peanut butter, oil and mayonnaise tend to react with oxygen, and would re-estabish a partial vacuum beneath the seal member 14 of the embodiment of FIGS. 1-4 if the cover 10 were tightly replaced after opening. That will not occur when the closure of FIGS. 5-8 is employed, because once the seal 24 has been breached, there is no mechanism to allow return to the convex condition. Thus the seal arrangement of FIGS. 5-8 is preferable for such products as mayonnaise, peanut butter or oil.

However, for other types of container contents, it may be preferable to package the contents under a reduced pressure to contract the seal 14 or 24 to a concave conformation. Either of the embodiments described can be employed with a pressure in the head space of the container sufficiently different than ambient pressure. The use of an overpressure and the consequent convex seal condition evidencing closure integrity has advantages, such as the possibility of using a less sturdy container than one which is filled at atmospheric pressure or under vacuum.

The invention, in either form, allows printing on the seal member, whether it be a member 14, or 16 or 24, avoiding the need to put printed content identification or other information on the cover 10 or 20.

Various modifications, choices of materials and applications of the closure of the invention will suggest themselves to those acquainted with the art. What is described is a tamper or leakage evident closure arrangement for containers.

What is claimed is:

1. A tamper evident closure for a container in which a cover is secured to a mouth of the container, comprising a flexible seal member between the container and the cover and visible through an opening in the cover, which seal member is secured to the cover and sealed to a rim of the container and adapted to be curved away from a flat condition by a difference between pressures existing inside and outside the container so that the integrity of the container is detectable without removal of the container cover and wherein the seal between the seal member and said rim is adapted to fail preferentially by shearing when opening while the seal member remains secured to said cover.

2. The closure of claim 1 wherein there are indicia on the seal member which indicia are visible without removal of the container cover.

3. The closure of claim 1 wherein the seal member consists of inner and outer members which are temporarily bonded to each other and wherein the inner member is secured to the rim of said container and the outer member remains secured to the cover.

4. The closure of claim 1, wherein the deformed seal member provides tactile evidence of a sealed container.

5. The closure of claim 1, wherein the deformation of the seal member accommodates internal pressure greater than atmospheric pressure without creating an illusion of product spoilage.

6. A method of providing a container with a seal for showing evidence of tempering or leakage of the container, comprising: providing a flexible seal member between the container and a cover for the container, said seal member being secured to the cover and sealed to a rim of the container; and providing a pressure within the container which differs from atmospheric pressure, whereby the seal member is deformed from a flat condition by the pressure difference; and providing an opening in the cover through which the deformation of the seal member is visible; wherein the seal between the seal member and said rim fails preferentially by shearing when opening while the seal member remains secured to said cover.

7. The method of claim 6 wherein the seal member consist of outer and inner members which are temporarily bonded to each other and wherein the inner member is secured to the rim of said container and the outer member remains secured to the cover.

8. The method of claim 7 wherein the outer seal member is deformed from a flat condition in conformity with the inner seal member.

9. The method of claim 7 wherein there are indicia on one or both seal members and for which the indicia is visible without removal of the container cover.

10. The method of claim 6 wherein there are indicia on the seal member which indicia are visible without removal of the container cover.

11. The method of claim 6 wherein the deformed seal member provides tactile evidence of a sealed container.

12. The method of claim 6 wherein the deformation of the seal member accommodates internal pressure greater than atmospheric without creating an illusion of product spoilage.

13. The method of claim 6, wherein said pressure within the container is greater than atmospheric pressure and is provided in said container by over-saturation with a soluble gas.

14. A tamper resistant food package, comprising:

A) a container including a mouth;

B) a cover for the container, said cover adapted to cooperatively engage the mouth of the container; and C) a tamper evident closure comprising a flexible seal member between the container and the cover and visible through an opening in the cover, which seal member is secured to the cover and sealed to a rim of the container and is curved away from a flat condition by a pressure greater than atmospheric pressure existing inside the container so that the integrity of the container is detectable without removal of the container cover wherein the seal between the seal member and said rim is adapted to fail preferentially by shearing when opening while the seal member remains secured to said cover.

15. The container of claim 14, further comprising indicia on the seal member which are visible without removal of the container cover.

16. The container of claim 14, wherein said pressure is provided in said container by over-saturation with a soluble gas.

* * * * *